US006481640B1

(12) United States Patent
Carey et al.

(10) Patent No.: US 6,481,640 B1
(45) Date of Patent: Nov. 19, 2002

(54) SADDLE SEAL INSERTION TOOL

(75) Inventors: Danuta H. Carey, Stockholm, NJ (US); Edward Hilferty, Sparta, NJ (US)

(73) Assignee: Titan Tool, Inc., Oakland, NJ (US)

( * ) Notice: Subject to any disclaimer, the term of this patent is extended or adjusted under 35 U.S.C. 154(b) by 0 days.

(21) Appl. No.: 09/560,256

(22) Filed: Apr. 26, 2000

(51) Int. Cl.[7] ..... B05B 15/02

(52) U.S. Cl. ..... 239/119; 239/600; 29/281.5; 29/467; 29/890.143

(58) Field of Search ..... 239/119, 600; 29/281.5, 271, 239, 467, 464, 890.143

(56) References Cited

U.S. PATENT DOCUMENTS 3,685,126 A * 8/1972 Kane
4,564,994 A * 1/1986 Marx
4,830,281 A * 5/1989 Calder
4,971,249 A * 11/1990 Tam et al.
5,340,029 A * 8/1994 Adams
5,765,753 A * 6/1998 Kieffer
5,947,381 A * 9/1999 Carey
6,264,115 B1 * 7/2001 Liska et al.

OTHER PUBLICATIONS

Graco—The New RAC 5 Reverse–A–Clear Switch Tip; from Graco website.

Photo copy of images of RAC 5 Tip.

* cited by examiner

*Primary Examiner*—David P. Bryant
(74) *Attorney, Agent, or Firm*—Faegre & Benson LLP

(57) ABSTRACT

A saddle seal and washer insertion tool for airless paint spray tip assemblies having a housing containing a reversible tip holder of the type having cylindrical barrel with a handle formed of a polymer, located on and positioned generally transversely of the barrel, the housing having a longitudinal through bore for permitting delivery of paint, and a transverse bore for receiving the barrel of the tip holder, the insertion tool formed integrally with an end of the handle, the tool having a first portion with a width conforming to an internal diameter of the washer and a second portion extending beyond the first portion with a width conforming to a diameter of a bore in the saddle seal such that the washer can be received on the first portion and the saddle seal received on the second portion for alignment and installation into the housing.

5 Claims, 7 Drawing Sheets

SADDLE SEAL INSERTION TOOL

TECHNICAL FIELD

The present invention relates to the field of reversible spray tips for airless paint spraying.

BACKGROUND OF THE INVENTION

Reversible tip assemblies for airless paint spraying typically have a saddle seal and elastomer washer for sealing the reversible tip turret in a housing on the front of a high pressure airless paint spray gun. Such assemblies require the removal and reinstallation or replacement of the saddle seal and washer frequently for cleaning and to maintain a leak-free assembly. In the past, it was difficult to install the saddle seal and washer because of the limited accessibility of the interior of the housing for the turret. Repeated attempts were often necessary to align and install the saddle seal and washer because of the inability to conveniently guide the saddle seal and washer into a closely intermitting bore in the housing receiving the saddle seal and washer. Prior art attempts to solve this problem have proved haphazard or costly, such as placing the saddle seal and washer on a pen or pencil tip to attempt to align the parts. Because of the conical nature of most pens and pencils, the saddle seal and washer were not held in alignment, but could rock or tilt during insertion, making the assembly process more difficult. Still another prior art attempt to solve this problem included machining a projection on the end of the turret or barrel to hold the saddle seal and/or washer, but was expensive to manufacture, because of the metal machining step required to obtain this projection.

SUMMARY OF THE INVENTION

The present invention overcomes shortcomings of the prior art by providing a stepped boss on one end of a plastic handle attached to the turret, with dimensions sized to closely interfit with the bores of the saddle seal and washer to maintain the saddle seal and washer in concentric alignment with each other, in right circular cylindrical alignment with the turret handle extension for ease of insertion of the saddle seal and washer into the housing. By molding the stepped boss on an end of the polymer handle, only a one-time tooling cost is incurred, thus greatly reducing the piece-part cost of manufacturing turrets as compared to machining a metal projection on each turret barrel.

BRIEF DESCRIPTION DRAWINGS

Figure 6:
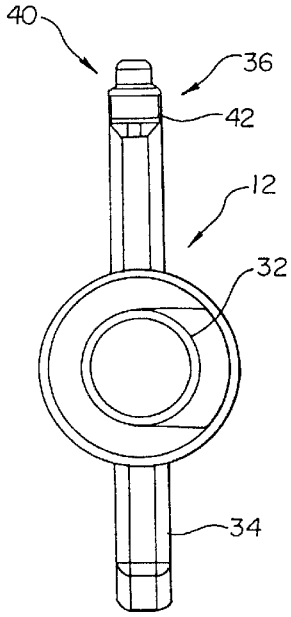

FIG. 6 s view of the turret from the barrel end.

Figure 7:
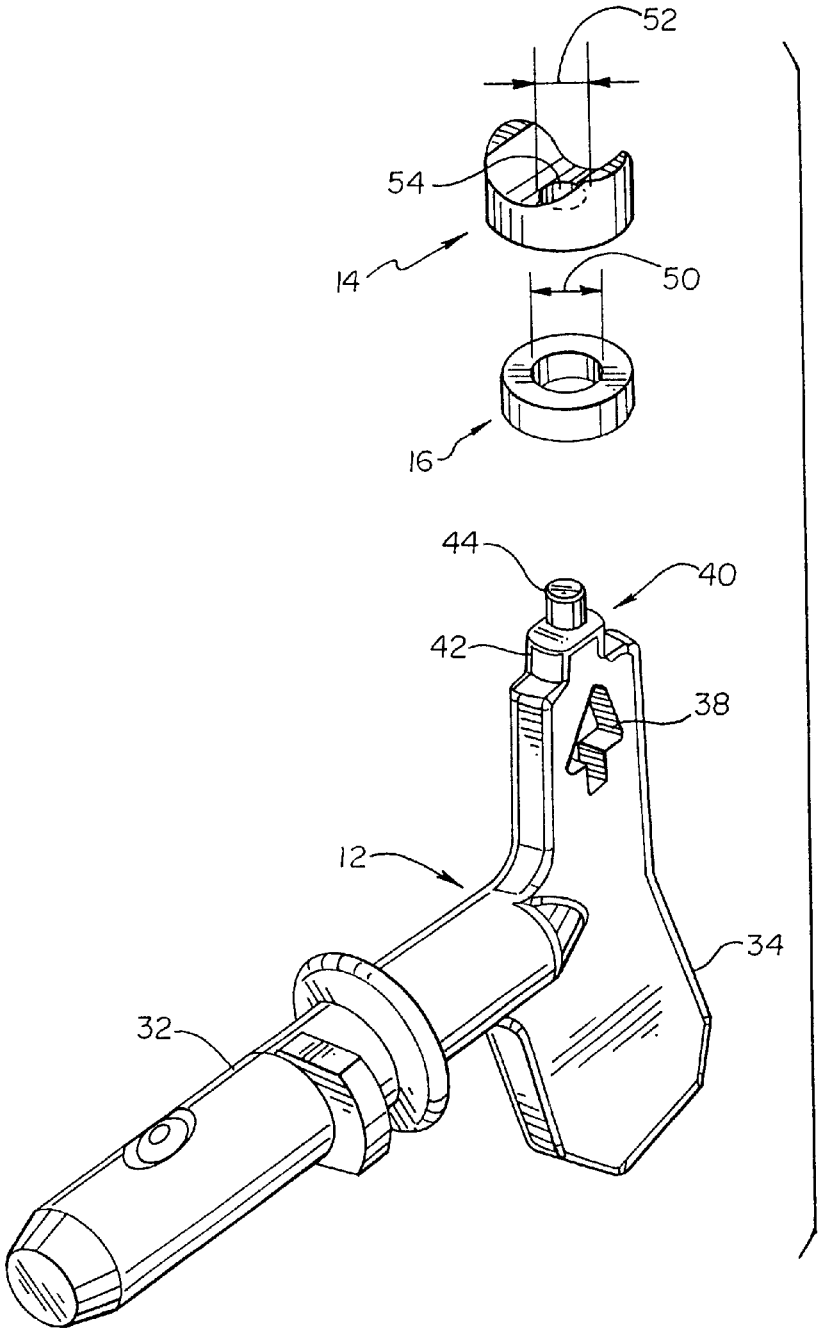

FIG. 7 is perspective exploded view of the turret, washer and saddle seal.

Figure 8:
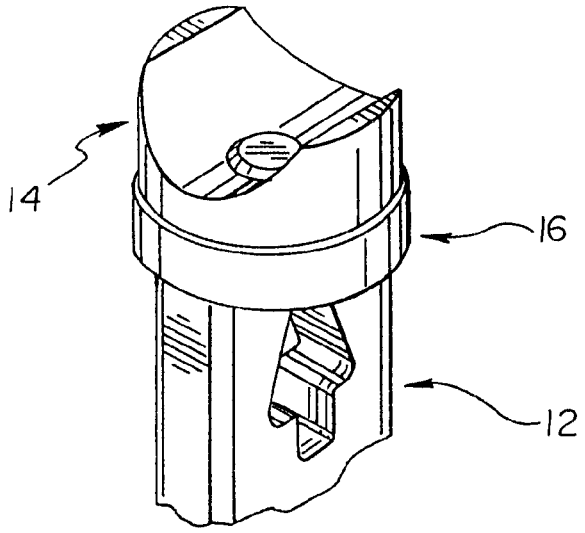

FIG. 8 is a fragmentary perspective view of the turret with the washer and saddle seal received on the stepped boss for installation of the saddle seal and washer into the housing.

Figure 9:
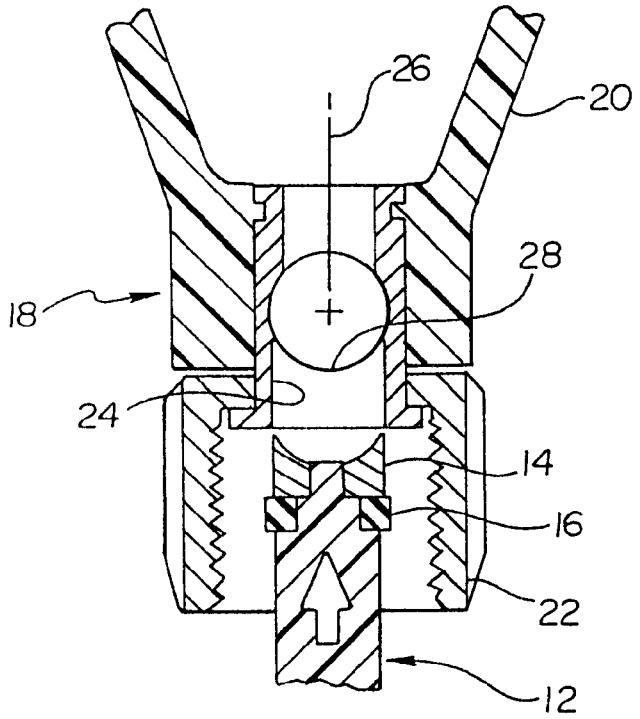

FIG. 9 is a fragmentary side section view of a portion of the housing and turret handle showing the parts immediately prior to installation of the saddle seal and washer into the housing.

Figure 10:
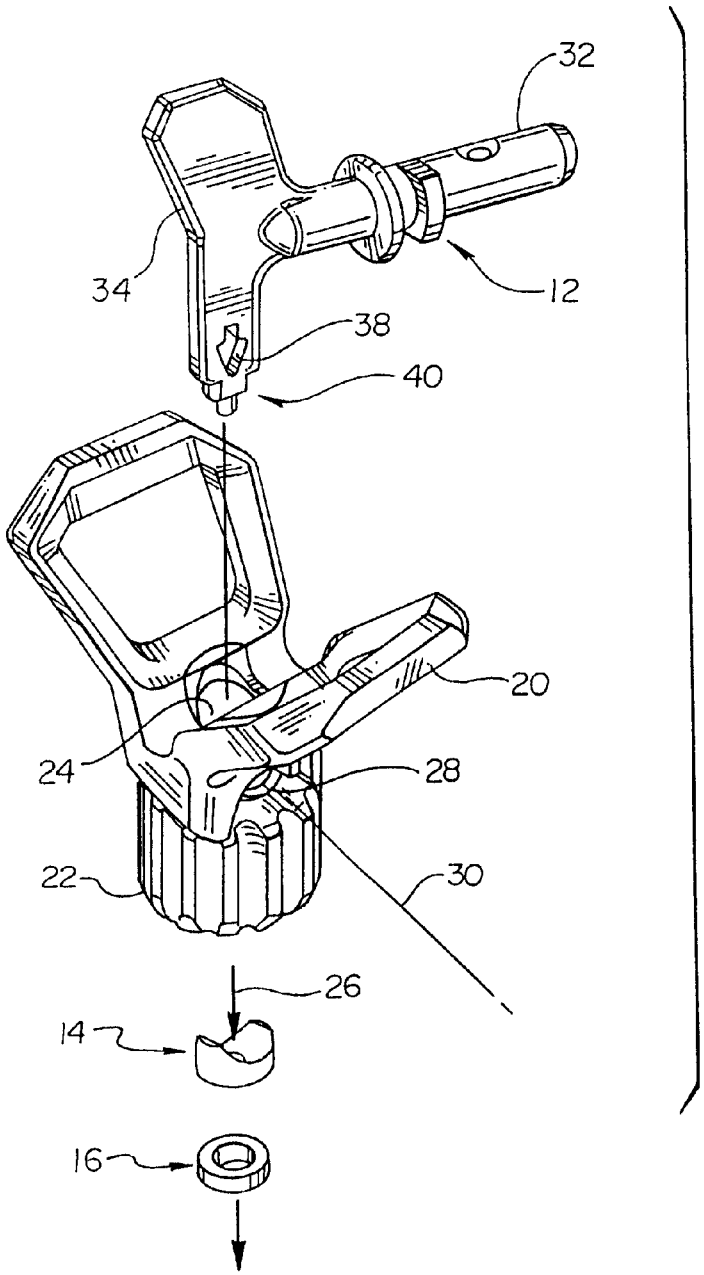

FIG. 10 is an exploded view illustrating ejection of the saddle seal and washer from the housing using the stepped boss of the turret handle.

DETAILED DESCRIPTION OF THE INVENTION

Figure 1:
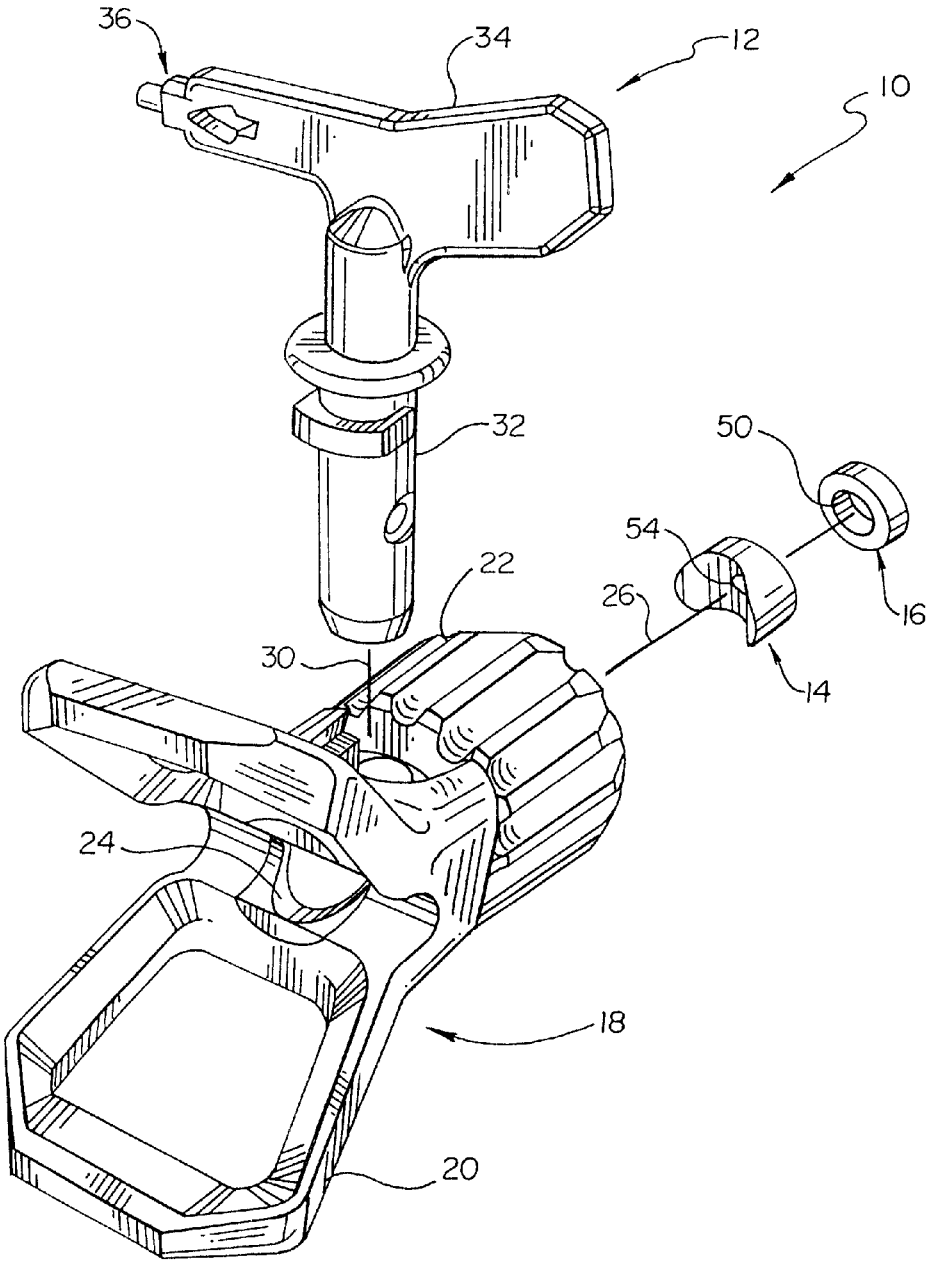
FIG. 1 is perspective view of a reversible tip holder or turret and housing assembly with the turret and saddle seal and washer shown in an exploded-format.
Figure 2:
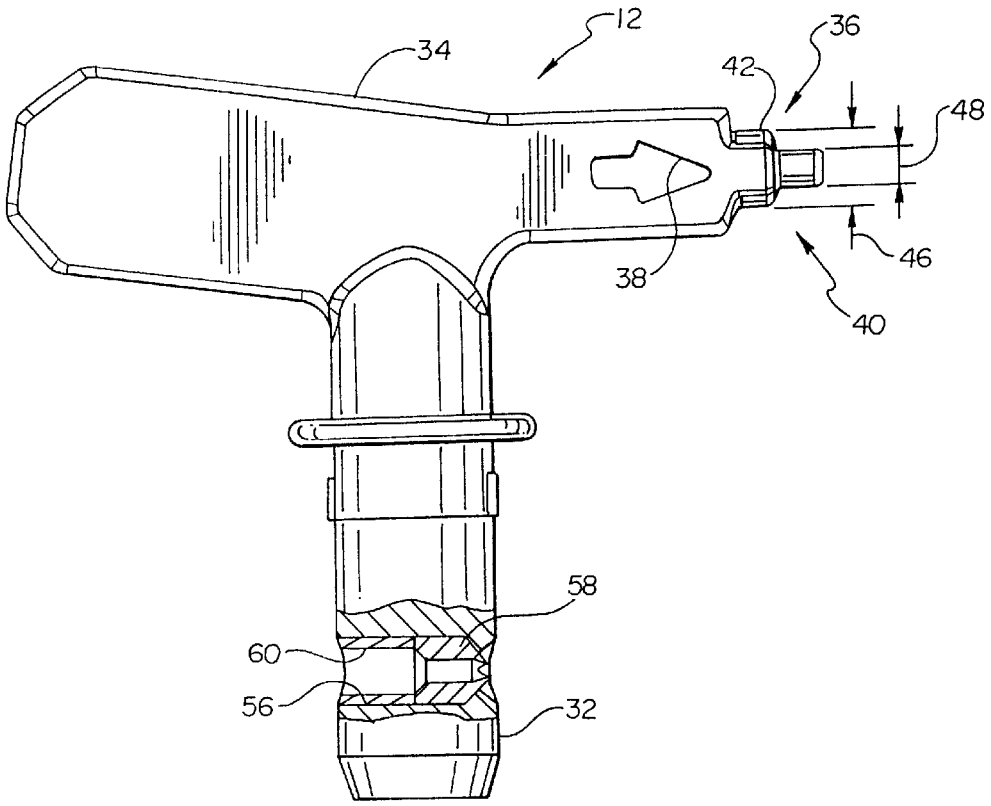
FIG. 2 is an enlarged side view of the reversible tip holder of FIG. 1 with the turret barrel shown partly in section to reveal the details of the spray tip assembly and diffuser holder.

Referring now to the Figures, and most particularly to FIG. 1, a reversible tip holder and housing assembly 10 may be seen, with a turret 12, saddle seal 14, and washer 16 shown removed from a housing 18. The housing 18 preferably has a tip guard 20 and a nut 22 for securing the assembly 10 to an airless paint spray gun (not shown). Housing 18 has a longitudinal bore 24 aligned with a longitudinal axis 26, and a transverse bore 28 aligned with a transverse axis 30. Transverse bore 28 receives a cylindrical barrel 32 of the turret 12 when turret 12 is installed in housing 18. Saddle seal 14 and washer 16 arc received in the longitudinal bore 24 and urged against barrel 32 by a front face (not shown) of a paint spray gun (also not shown. Barrel 32 and saddle seal 14 are each preferably formed of metal, most preferably steel.

Referring now also to FIGS. 2, 4, 5, 6, and 7 the reversible tip holder or turret 12 also has a handle 34 preferably formed of a polymeric material such as nylon, secured to the of barrel 32. Handle 34 preferably forms a "Tee" shape with barrel 32, and it is to be understood that the barrel 32 may be rotated in housing 18 by grasping and turning handle 34, to move the turret between a spraying position (when turret 12 is installed in the housing 18 and arrow 38 is directed downstream) and a cleaning position (when arrow 38 is directed upstream). Handle 34 also has an end 36 with a stepped boss 40 formed integrally therewith.

Boss 40 has a first portion 42 and a second portion 44. First portion 42 preferably has a width 46 conforming to an inside diameter 50 of washer 16. To conform, width 46 may be slightly less than, slightly greater than, or equal to diameter 50. It is to be understood, however, that if it is slightly greater than the diameter, the width will have an interference fit with diameter 50, however, first portion 42 must not grip washer 16 so tightly that installation of washer 16 in housing 18 is impeded.

Second portion 44 has a width 48 conforming to an inside diameter 52 of a bore 54 in saddle seal 14. In a preferred form, second portion 44 is cylindrical, as perhaps may be most clearly seen in FIG. 7.

Referring again to FIG. 2, barrel 32 has a transverse bore 56 therethrough, with a carbide spray tip 58 and a diffuser holder 60 therein. It is to be understood that holder 60 is preferably press fitted into bore 56, and then any projecting portion of holder 60 is ground to a cylindrical contour to match the cylindrical surface of barrel 32. Alternatively, internal threads may be provided in bore 56, and a sealing washer and hollow set screw (not shown) inserted behind tip 58 to retain tip 58 in barrel 32. In such an arrangement, it is to be understood that the set screw will preferably be tightened sufficiently to be within the cylindrical envelope of barrel 32 to avoid interference with saddle seal 14 when turret 12 is moved within housing 18.

Figure 3:
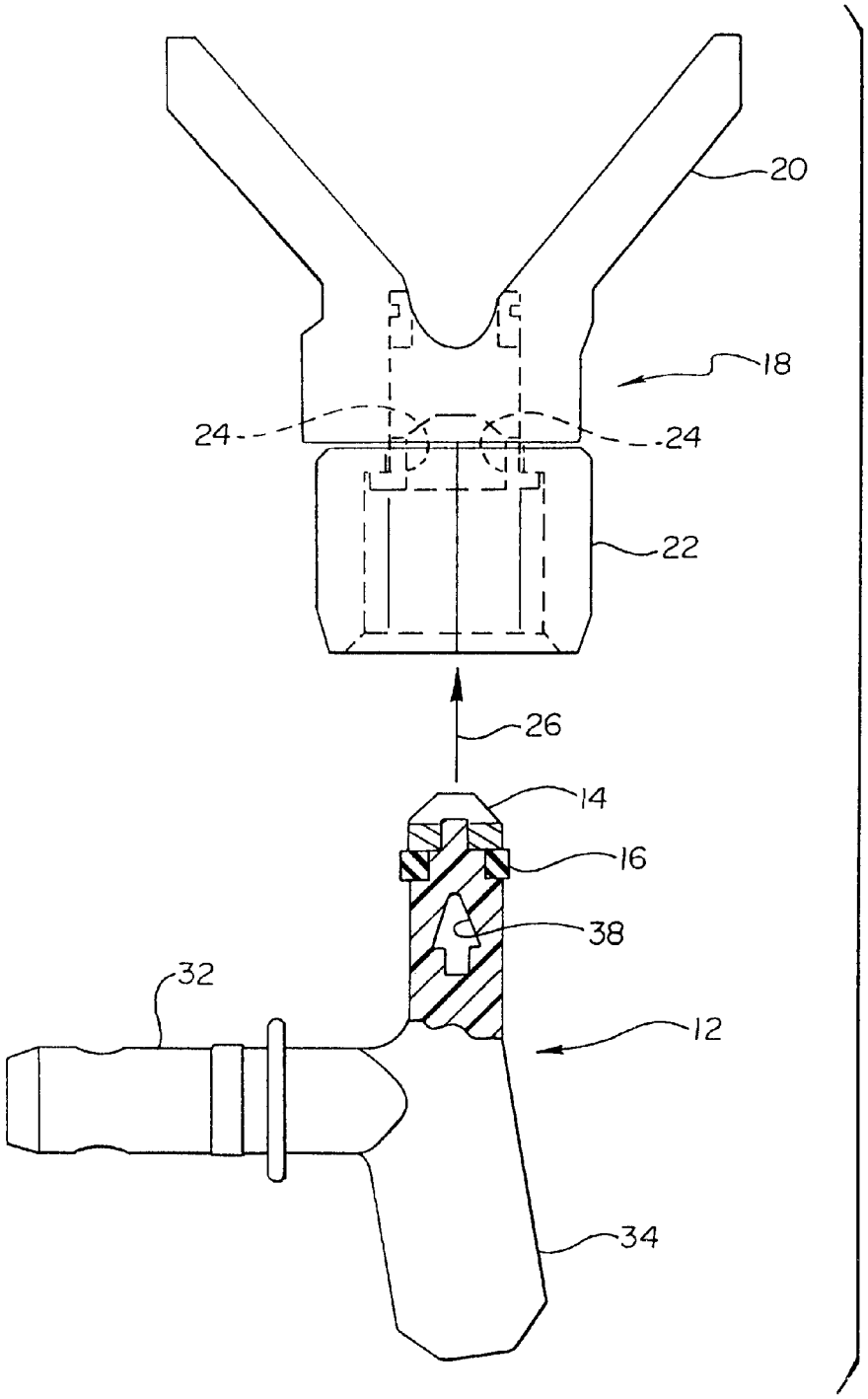
FIG. 3 is view of the housing and turret with the saddle seal and washer mounted on the stepped boss of the turret handle ready for installation of the saddle seal and washer into the housing, with the turret handle shown partly in section.
Figure 4:
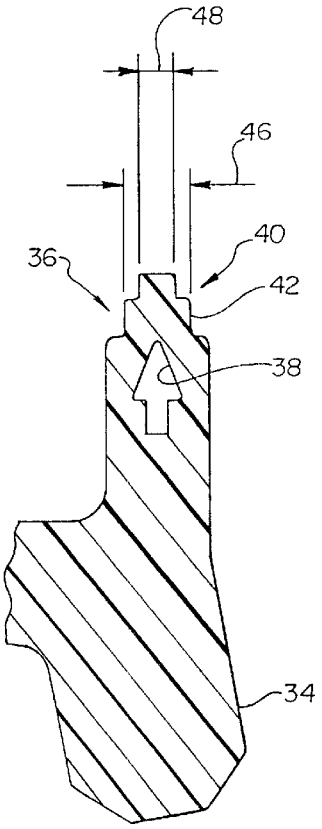
FIG. 4 is a fragmentary section view of the turret handle taken along line 4—4 of FIG. 5.
Figure 5:
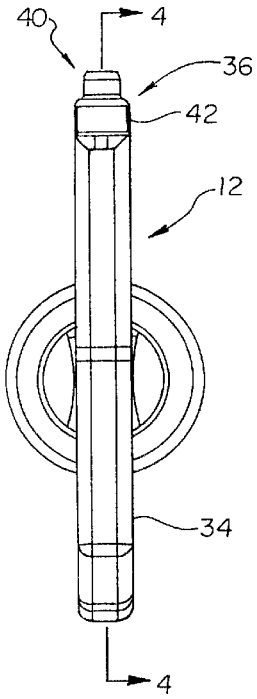
FIG. 5 is a view of the turret from the handle end.

Referring now to FIGS. 3, 7, 8 and 9, to use the tool to install the saddle seal and washer in the housing the washer is first placed on the first portion 42, then the saddle seal 14 is placed on the second portion 44 and the handle 34 is used to align and insert the saddle seal and washer into the longitudinal bore 24 from the rear of the housing 18, as illustrated in FIG. 3. As may be seen most clearly in FIGS. 3 and 9, the end 36 is preferably narrower than the outside diameters of the washer and the saddle seal, to facilitate removal or ejection of the saddle seal 14 and washer 16 from bore 24 of housing 18, as illustrated in FIG. 10. In the removal process, second portion 44 may be engaged from the front in the bore 54 of saddle seal 14 to eject the seal and washer from the housing 18.

The invention is not to be limited to all of the details thereof, as modifications and variations thereof may be made without departing from the spirit or scope of the invention.

What is claimed is:

1. A saddle seal and washer insertion tool formed integrally with a handle of a turret for a reversible paint spray tip of the type having a cylindrical barrel with the handle located thereon and positioned generally transversely of the barrel, the tool comprising: a stepped boss integrally formed with an end of the handle having a first portion having a width conforming to an internal diameter of the washer and a second portion extending beyond the first portion and having a width conforming to a diameter of a bore in the saddle seal such that the washer can be received on the first portion and the saddle seal received on the second portion for alignment and installation into a housing for the turret.

2. The insertion tool of claim 1 wherein the width of the first portion and the internal diameter of the washer are sized to provide a slight interference fit.

3. The insertion tool of claim 1 wherein the end of the handle adjacent the first portion has a width less than an outside diameter of the washer.

4. The insertion tool of claim 1 wherein the end of the handle adjacent the first portion has a width less than an outside diameter of the saddle seal.

5. The insertion tool of claim 1 wherein the handle is formed of nylon.

* * * * *